US009116475B2

(12) United States Patent
Hazeyama et al.

(10) Patent No.: US 9,116,475 B2
(45) Date of Patent: Aug. 25, 2015

(54) FIXING DEVICE FIXING TRANSFERRED DEVELOPING AGENT IMAGE TO SHEET

(71) Applicant: Brother Kogyo Kabushiki Kaisha, Nagoya-shi, Aichi-ken (JP)

(72) Inventors: Tomoaki Hazeyama, Yokkaichi (JP); Naoyuki Iwata, Kakamigahara (JP); Yasuhiro Maruyama, Kasugai (JP); Yusuke Murodate, Nagoya (JP); Akihiro Kobayashi, Inazawa (JP); Yuji Nishigaki, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/227,040

(22) Filed: Mar. 27, 2014

(65) Prior Publication Data

US 2014/0294465 A1 Oct. 2, 2014

(30) Foreign Application Priority Data

Mar. 29, 2013 (JP) ..... 2013-074369

(51) Int. Cl.
*G03G 15/20* (2006.01)

(52) U.S. Cl.
CPC ..... *G03G 15/2017* (2013.01); *G03G 15/2053* (2013.01); *G03G 15/2028* (2013.01); *G03G 2215/2035* (2013.01); *G03G 2215/2064* (2013.01)

(58) Field of Classification Search
CPC ..... G03G 15/2017; G03G 2215/2035; G03G 2215/2064
USPC ..... 399/122, 329
See application file for complete search history.

(56) References Cited

U.S. PATENT DOCUMENTS

| | | | | |
|---|---|---|---|---|
| 5,752,149 | A * | 5/1998 | Yuza et al. | 399/329 |
| 6,775,509 | B2 | 8/2004 | Shida et al. | |
| 2003/0156866 | A1 | 8/2003 | Shida et al. | |
| 2008/0069611 | A1 * | 3/2008 | Obata et al. | 399/331 |

(Continued)

FOREIGN PATENT DOCUMENTS

| | | | |
|---|---|---|---|
| JP | 2003-228246 | A | 8/2003 |
| JP | 3817482 | B2 | 9/2006 |
| JP | 2011-137933 | A | 7/2011 |

OTHER PUBLICATIONS

Co-pending U.S. Appl. No. 14/227,011, filed Mar. 27, 2014.

(Continued)

*Primary Examiner* — Benjamin Schmitt
(74) *Attorney, Agent, or Firm* — Banner & Witcoff, Ltd.

(57) ABSTRACT

Some fixing devices include a nip member, an endless belt, a rotating member and a stay. The stay, in some arrangements, has a first supporting face. Additionally, the first supporting face includes a first downstream edge. The first downstream edge includes a first portion, a third portion, and a second portion. According to various aspects, the second portion is positioned between the first portion and the third portion. The second supporting face includes a second downstream edge. The second downstream edge has a fourth portion, a sixth portion, and a fifth portion. According to further aspects, the second portion and the fifth portion define a first distance while the first portion and the fourth portion define a second distance, and the third portion and the sixth portion define a third distance. The second distance and the third distance is longer than the first distance in some examples.

20 Claims, 10 Drawing Sheets

(56) References Cited

U.S. PATENT DOCUMENTS

| | | | | |
|---|---|---|---|---|
| 2011/0170920 | A1 | 7/2011 | Fujiwara et al. | |
| 2011/0200369 | A1* | 8/2011 | Shinshi | 399/329 |

OTHER PUBLICATIONS

Co-pending U.S. Appl. No. 14/227,016, filed Mar. 27, 2014.
Co-pending U.S. Appl. No. 14/227,025, filed Mar. 27, 2014.

* cited by examiner

FIG. 7A
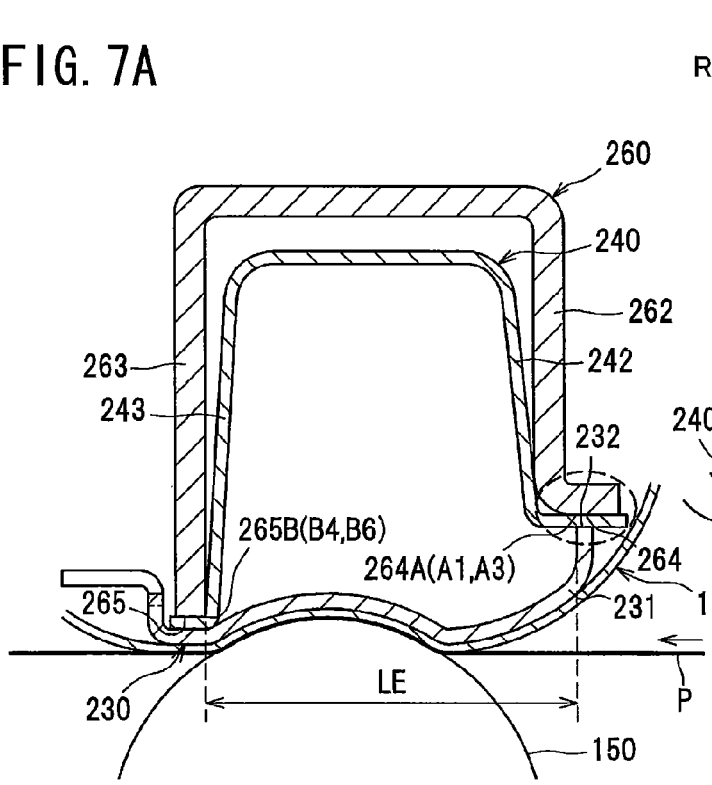
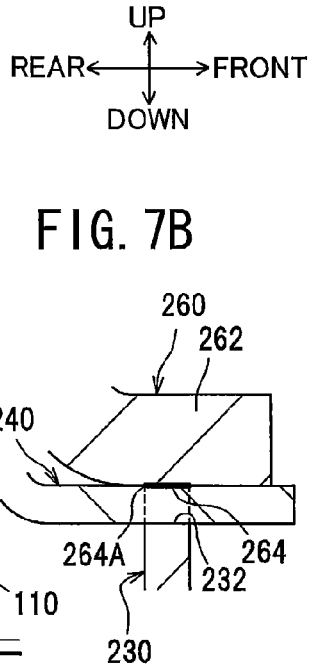
FIG. 7B

FIXING DEVICE FIXING TRANSFERRED DEVELOPING AGENT IMAGE TO SHEET

CROSS REFERENCE TO RELATED APPLICATION

This application claims priority from Japanese Patent Application No. 2013-074369 filed Mar. 29, 2013. The entire content of the priority application is incorporated herein by reference.

TECHNICAL FIELD

The present invention relates to a fixing device that thermally fixes a transferred developing agent image to a sheet.

BACKGROUND

Japanese Patent No. 3817482 discloses a fixing device that includes an endless belt, a nip member disposed at an internal space of the endless belt, and a pressure roller that opposes the nip member so as to interpose the endless belt between the pressure roller and the nip member. More specifically, the nip member is subjected to machining to have a convex surface in contact with the endless belt and having a central portion and end portions in an axial direction of the endless belt. The central portion has a protruding amount protruding toward the pressure roller greater than that of the end portions. In this way, wrinkling of recording sheets can be prevented.

SUMMARY

However, with the conventional technology, the protruding amount of the central portion of the nip member must be directly adjusted by machining the surface of the nip member to be in contact with the endless belt. Here, accurate machining is troublesome, and dimensional error may occur in the amount of protrusion.

In view of the foregoing, it is an object of the present invention to provide a fixing device capable of reducing dimensional error in the protrusion amount of the central portion of the nip member.

In order to attain the above and other objects, the present invention provides a fixing device that may include a nip member, an endless belt, a rotating member, and a stay. The endless belt may have an inner peripheral surface and an outer peripheral surface. The inner peripheral surface may be configured to be in sliding contact with the nip member in a sliding direction. The rotating member may be configured to nip the endless belt in cooperation with the nip member, and may be configured to constitute a nip region between the endless belt and the rotating member. The rotating member may have an axis defining an axial direction. The stay may be disposed opposite to the nip region with respect to the nip member and may have a first supporting face configured to support the nip member and a second supporting face configured to support the nip member. The second supporting face may be spaced apart from the first supporting face in the sliding direction and may be disposed downstream of the first supporting face in the sliding direction. The first supporting face may have a first upstream edge and a first downstream edge positioned downstream of the first upstream edge in the sliding direction. The first downstream edge may have one side portion as a first portion, another side portion as a third portion, and a central portion as a second portion in the axial direction. The first portion may be positioned opposite to the third portion in the axial direction. The second portion may be positioned between the first portion and the third portion. The second supporting face may have a second upstream edge and a second downstream edge positioned downstream of the second upstream edge in the sliding direction. The second downstream edge may have one side portion as a fourth portion, another side portion as a sixth portion, and a central portion as a fifth portion in the axial direction. The fourth portion may be positioned opposite to the sixth portion in the axial direction. The fifth portion may be positioned between the fourth portion and the sixth portion. The second portion and the fifth portion may define a first distance therebetween in the sliding direction. The first portion and the fourth portion may define a second distance therebetween in the sliding direction. The third portion and the sixth portion may define a third distance therebetween in the sliding direction. The second distance and the third distance may be longer than the first distance.

The present invention further provides a fixing device that may include a nip member, an endless belt, a rotating member, and a stay. The endless belt may have an inner peripheral surface and an outer peripheral surface. The inner peripheral surface may be configured to be in sliding contact with the nip member in a sliding direction. The rotating member may be configured to nip the endless belt in cooperation with the nip member, and may be configured to constitute a nip region between the endless belt and the rotating member. The rotating member may have an axis defining an axial direction. The stay may have a first supporting face configured to support the nip member and a second supporting face configured to support the nip member. The second supporting face may be spaced apart from the first supporting face in the sliding direction and may be disposed downstream of the first supporting face in the sliding direction. The first supporting face may have a first upstream edge and a first downstream edge positioned downstream of the first upstream edge in the sliding direction. The first downstream edge may have one side portion as a first portion, another side portion as a third portion, and a central portion as a second portion in the axial direction. The first portion may be positioned opposite to the third portion in the axial direction. The second portion may be positioned between the first portion and the third portion. The second supporting face may have a second upstream edge and a second downstream edge positioned downstream of the second upstream edge in the sliding direction. The second downstream edge may have one side portion as a fourth portion, another side portion as a sixth portion, and a central portion as a fifth portion in the axial direction. The fourth portion may be positioned opposite to the sixth portion in the axial direction. The fifth portion may be positioned between the fourth portion and the sixth portion. The second portion and the fifth portion may define a first distance therebetween in the sliding direction. The first portion and the fourth portion may define a second distance therebetween in the sliding direction. The second distance may be longer than the first distance.

BRIEF DESCRIPTION OF THE DRAWINGS

In the drawings:

FIGS. 7A and 7B show an end portion of a stay according to a third modification of the present invention.

DETAILED DESCRIPTION

Figure 1:
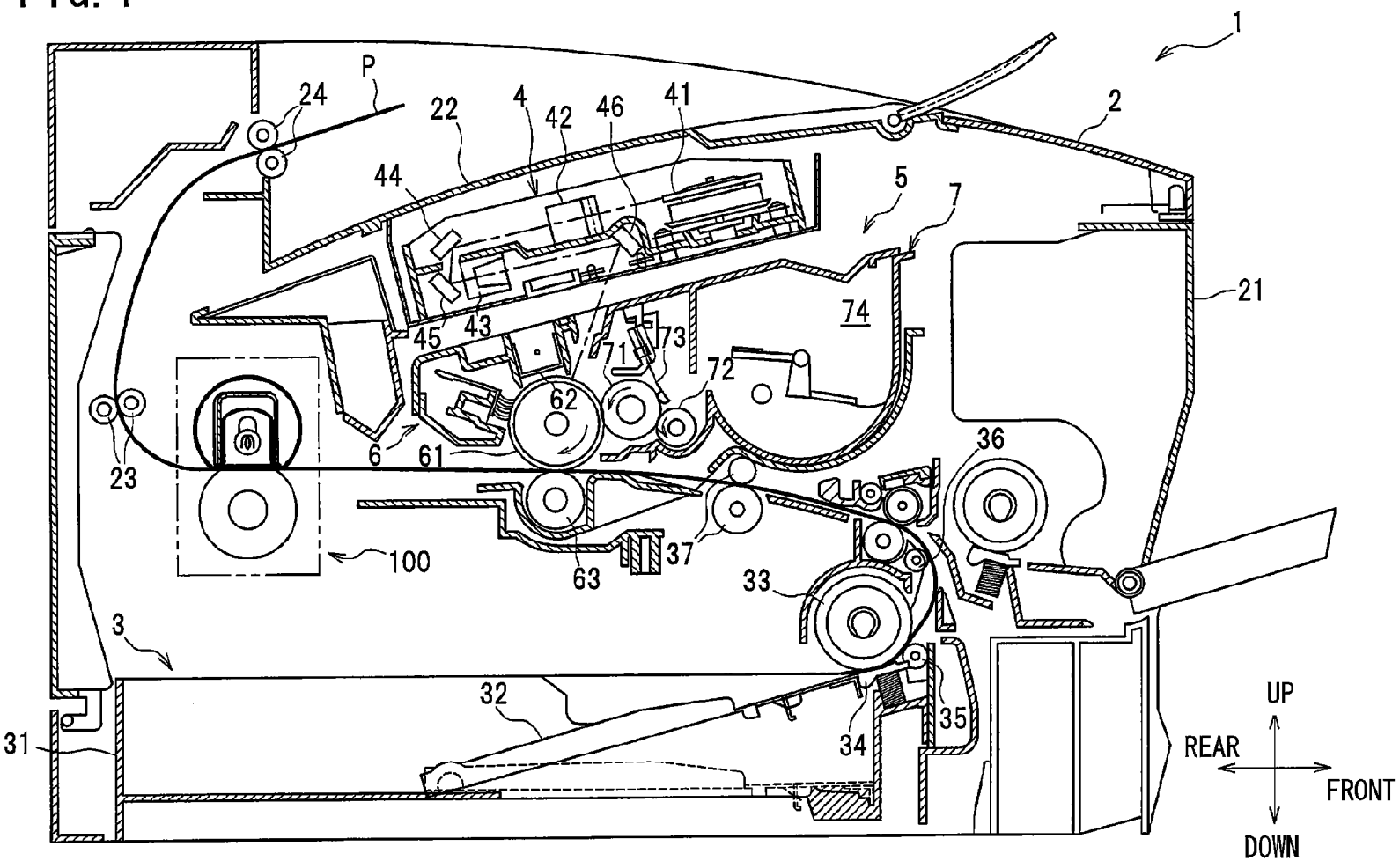
FIG. 1 is a schematic cross-sectional view showing a structure of a laser printer having a fixing device according to one embodiment of the present invention.

A general structure of a laser printer as an image forming device according to one embodiment of the present invention will be described with reference to FIG. 1. A laser printer 1 shown in FIG. 1 is provided with a fixing device 100 according to the embodiment of the present invention. A detailed structure of the fixing device 100 will be described later while referring to FIGS. 2 to 4D.

<General Structure of Laser Printer>

As shown in FIG. 1, the laser printer 1 includes a main frame 2. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" will be used assuming that the laser printer 1 is disposed in an orientation in which it is intended to be used. More specifically, in FIG. 1, a left side and a right side of the figure are a rear side and a front side of the printer, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35 and 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35 and 36, and the registration rollers 37.

The exposure unit 4 is disposed at an upper portion of the main frame 2. The exposure unit 4 includes a laser emission unit (not shown), a polygon mirror 41, lenses 42 and 43, and reflection mirrors 44, 45 and 46. In the exposure unit 4, the laser emission unit is adapted to project a laser beam based on image data so that the laser beam is deflected by or passes through the polygon mirror 41, the lens 42, the reflection mirrors 44 and 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a doctor blade 73 for regulating toner thickness, and a toner accommodating portion 74 in which toner is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the doctor blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
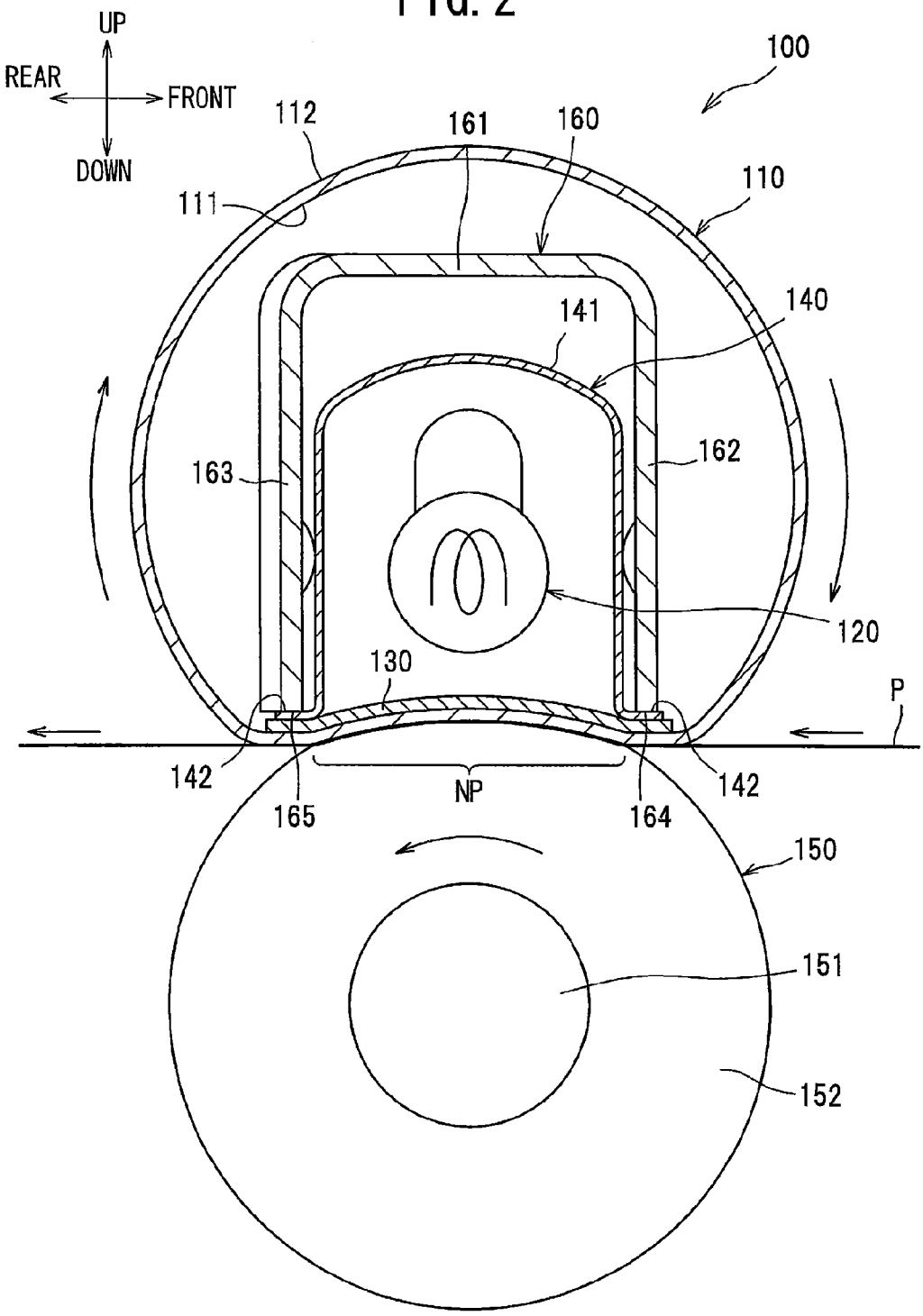
FIG. 2 is a cross-sectional view of the fixing device.
Figure 3:
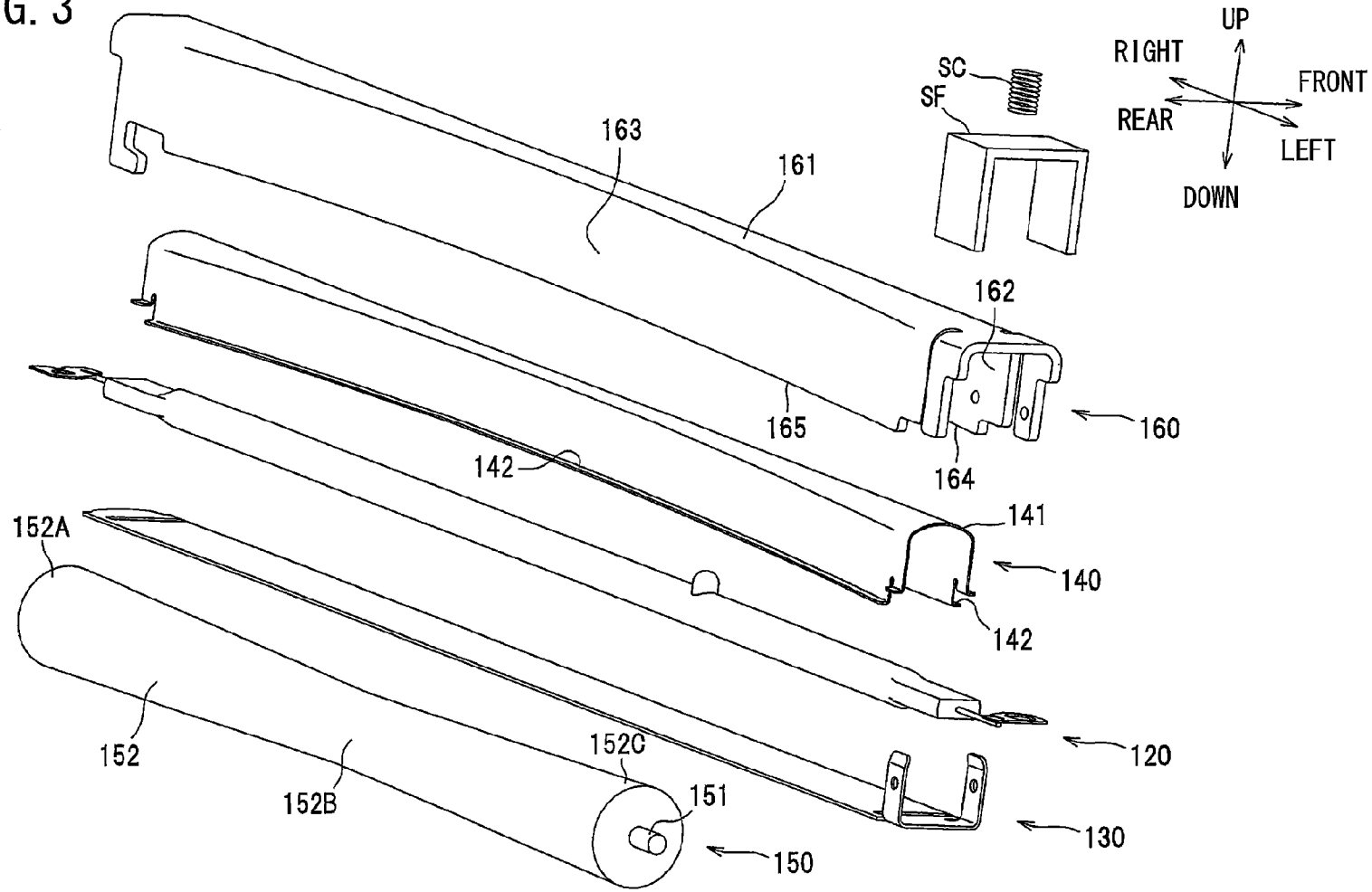
FIG. 3 is an exploded perspective view showing a halogen lamp, a nip plate, a reflection plate, a pressure roller, and a stay.

As shown in FIGS. 2 and 3, the fixing device 100 includes a fusing belt 110, a halogen lamp 120, a nip plate 130, a reflection plate 140, a pressure roller 150, and a stay 160. In FIG. 3, for the sake of convenience a length of the pressure roller 150 in a leftward/rightward direction is shown as being shorter than that of the nip plate 130, but in actuality the length of the pressure roller 150 in the leftward/rightward direction is approximately the same as that of the nip plate 130. (See FIG. 4D.)

The fusing belt 110 is a heat-resistant and flexible endless belt. The fusing belt 110 has a metallic tube and a fluorocarbon resin layer coated thereover. The metallic tube is made from stainless steel. The fusing belt 110 has an inner peripheral surface 111 in sliding contact with the nip plate 130, and an outer peripheral surface 112 in sliding contact with the pressure roller 150.

The inner peripheral surface 111 is in sliding contact with the nip member and runs rearward relative to the nip plate 130. Here, the sliding contact direction of the inner peripheral surface 111 relative to the nip plate 130 refers to an average direction in which the inner peripheral surface 111 is in sliding contact with any points of the nip plate 130 in the frontward/rearward direction. In this embodiment, the sliding contact direction refers to a direction extending in the frontward/rearward direction in FIG. 2. In other words, the sliding contact direction refers to a direction that extends from an upstream end to a downstream end of a nip region NP relative to a rotation direction of the pressure roller 150.

As a modification to the fusing belt 110, a rubber layer can be provided between the metallic tube and the fluorocarbon resin layer.

The halogen lamp 120 is a heater to generate a radiant heat to heat the nip plate 130 and the fusing belt 110 for heating toner on the sheet S. The halogen lamp 120 is positioned at the internal space of the fusing belt 110 such that the halogen lamp 120 is spaced away from the inner peripheral surface of the fusing belt 110 as well as an inner (upper) surface of the nip plate 130 by a predetermined distance.

The nip plate 130 is an elongated member extending in the leftward/rightward direction, and is formed into a substantially plate-like shape. The nip plate 130 is disposed to be in sliding contact with the inner peripheral surface 111 of the tubular fusing belt 110. The nip plate 130 is adapted to transfer the radiant heat received from the halogen lamp 120 and onto the toner on the sheet P through the fusing belt 110.

This nip plate 130 is formed into a planar shape and is made from a metal, for example, aluminum, so as to have a thermal conductivity higher than that of a stay 160 made from a steel (described later). This nip plate 130 has a thickness permitting bending deformation thereof. The surface of the nip plate 130 that is in contact with the inner peripheral surface 111 of the fusing belt 110 can be coated with, for example, a metal oxide film or a fluororesin layer. Moreover, the thickness of the nip plate 130 can be ranging from 0.1 to 3.0 mm, or 0.3 to 2.0 mm, or 0.1 to 1.0 mm.

The reflection plate 140 is adapted to reflect radiant heat from the halogen lamp 120 toward the nip plate 130. As shown in FIG. 2, the reflection plate 140 is positioned within the fusing belt 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing belt 110.

The reflection plate 140 is configured into substantially U-shape in cross-section and is made from a material such as aluminum having high reflection ratio for infrared rays or far infrared rays. The reflection plate 140 has substantially a U-shaped reflection portion 141 and a flange portion 142 extending outward from each end portion of the reflection portion 141 in the frontward/rearward direction. A mirror surface finishing is applicable on the surface of the aluminum reflection plate 140 for specular reflection in order to enhance heat reflection ratio.

The pressure roller 150 is an elastically deformable member. The pressure roller 150 is disposed downward of the nip plate 130 to vertically oppose the outer peripheral surface 112 of the fusing belt 110. The pressure roller 150 is rotatable about an axis extending in the leftward/rightward direction. The pressure roller 150 is configured to provide the nip region NP in cooperation with the fusing belt 110, when the fusing belt 110 is nipped between the pressure roller 150 and the nip plate 130 while the pressure roller 150 is in an elastically deformed state.

The pressure roller 150 has a metallic shaft 151 and a rubber layer 152 formed over an outer periphery of the shaft 151. The shaft 151 is formed into a linear shape, with a radius that is substantially constant across the leftward/rightward direction.

The rubber layer 152 has a first end portion 152A, a central portion 152B, and a second end portion 152C, in the axial direction (leftward/rightward direction) of the pressure roller 150. The rubber layer 152 is formed into a concave shape such that respective outer diameters of the end portions 152A and 152C are larger than an outer diameter of the central portion 152B when fixing operation is not being performed (heat is not being applied) and when fixing operation is being performed. In other words, the rubber layer 152 is formed such that the end portions 152A and 152C are thicker than the central portion 152B.

The pressure roller 150 is rotationally driven by a drive motor (not shown) disposed in the main frame 2. By the rotation of the pressure roller 150, the fusing belt 110 is circularly moved along the nip plate 130 because of a friction force generated therebetween or between the sheet P and the fusing belt 110. A toner image on the sheet P can be thermally fixed thereto by heat and pressure during passage of the sheet P at the nip region NP between the pressure roller 150 and the fusing belt 110.

The stay 160 is adapted to support the end portions of the nip plate 130 through the flange portion 142 for maintaining rigidity of the nip plate 130. The stay 160 is positioned on the opposite side of the nip region NP with respect to the nip plate 130. The stay 160 has a substantially U-shape configuration in conformity with the outer shape of the reflection portion 141 covering the reflection plate 140. For fabricating the stay 160, a highly rigid member such as a steel plate is folded into substantially U-shape.

The stay 160 is disposed upward of the reflection plate 140. The stay 160 has a top wall 161, a front wall 162, and a rear wall 163. The top wall 161 is formed into a planar shape. The front wall 162 extends downward from a front end of the top wall 161. The rear wall 163 extends downward from a rear end of the top wall 161. As shown in FIG. 3, the rear wall 163 is formed into an arcuate shape in cross-sectional view and has a central portion and end portions in the leftward/rightward direction, with the central portion recessed inward (frontward) more than the end portions in the frontward/rearward direction. In addition, the reflection portion 141 of the reflection plate 140 has a rear wall which is also formed into an arcuate shape in cross-sectional view in conformance with the shape of the rear wall 163. The stay 160 and the reflection plate 140 are formed into these respective shapes using press working.

The stay 160 has left and right end portions that are respectively supported by left and right side frames SF (only a left side frame is shown in FIG. 3). The side frames SF are vertically movably supported by a fixing frame (not shown) of the fixing device 100. In addition, the nip plate 130 and the reflection plate 140 are supported indirectly by the side frames SF through the stay 160.

Coil springs CS (only a left coil spring is shown in FIG. 3) are provided for urging the respective side frames SF downward. Thus, the side frames SF press the nip plate 130 toward the pressure roller 150 through the stay 160 and the reflection plate 140. Incidentally, as modifications, the halogen lamp 120 can be supported by the side frames SF or by the fixing frame. Further, the stay 160 and the nip plate 130 can be fixed to the fixing frame, whereas the pressure roller 150 is urged toward the nip plate 130 by a urging member. Moreover, instead of the coil spring CS, a combination of an arm and a coil spring is available.

As shown in FIG. 2, the front wall 162 has a lower end at which is located an end face constituting a first supporting face 164 that supports the nip plate 130 through the flange portion 142 of the reflection plate 140. The rear wall 163 has a lower end at which is located an end face constituting a second supporting face 165 that supports the nip plate 130 through the flange portion 142 of the reflection plate 140.

Figure 4A:
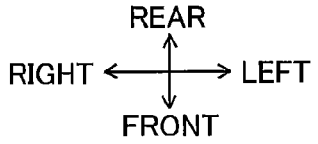
FIG. 4A is a bottom view showing each position of a first supporting surface and a second supporting surface.
Figure 4A:
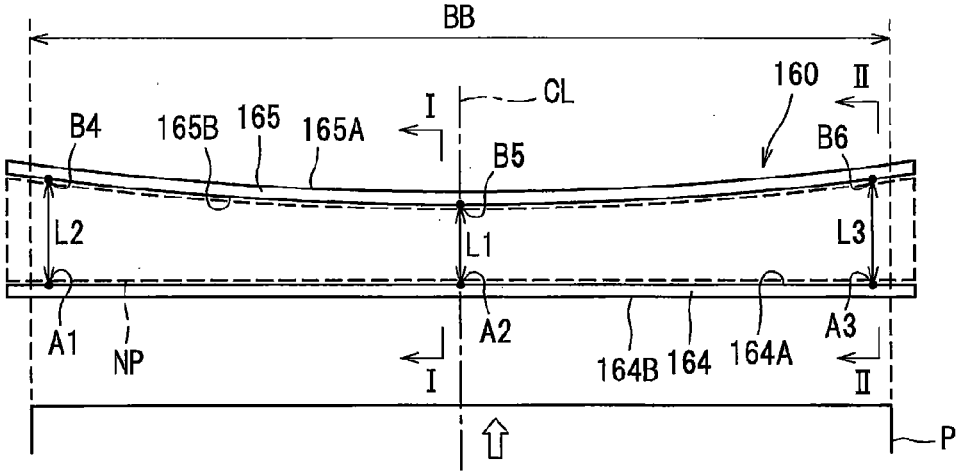
Figure 4B:
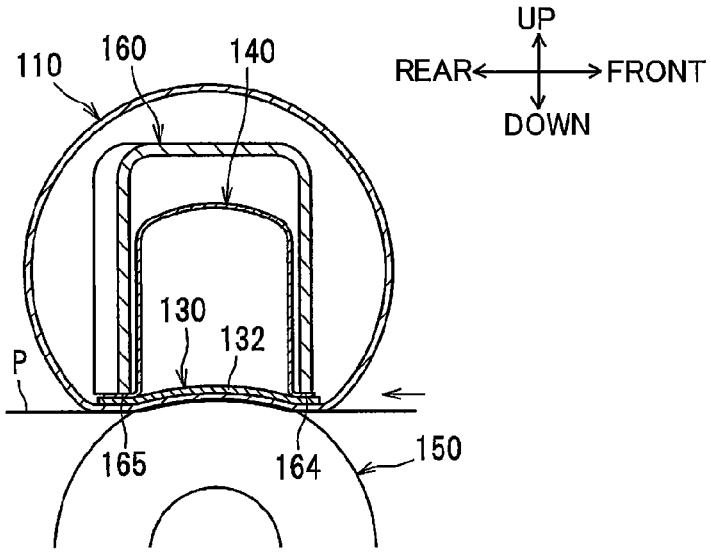
FIG. 4B is a cross sectional view taken along line I-I of FIG. 4A.
Figure 4C:
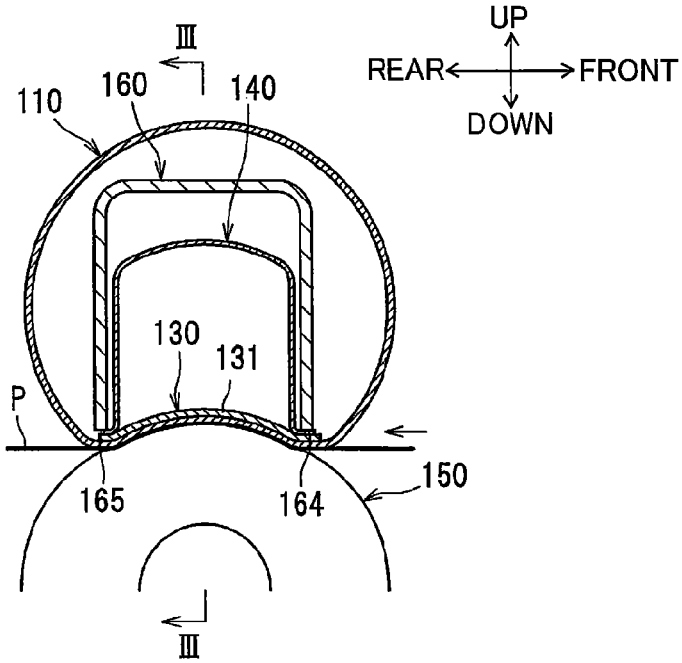
FIG. 4C is a cross sectional view taken along line II-II of FIG. 4A.

As shown in FIG. 4A, the first supporting face 164 has a first downstream edge 164A and a first upstream edge 164B. The first downstream edge 164A is located at a rear side, i.e. downstream in the sliding direction, of the first supporting face 164, and the first upstream edge 164B is located at a front side, i.e. upstream in the sliding direction, of the first supporting face 164. In other words, the first downstream edge 164A is located on a downstream of the first supporting face 164, and the first upstream edge 164B is located on an upstream of the first supporting face 164, in a direction of conveyance of the sheets P.

The first downstream edge 164A has a first point (first portion) A1, a second point (second portion) A2, and a third point (third portion) A3. The first point A1 is located at the first end side; the second point A2 is positioned at the central portion; the third point A3 is located at the second end side in the leftward/rightward direction, i.e. the axial direction of the pressure roller 150. The first point A1, the second point A2, and the third point A3 are located on a straight line extending in the leftward/rightward direction, and are thus arrayed in the leftward/rightward direction. The first upstream edge 164B is formed in conformance with the first downstream edge 164A.

The second supporting face 165 is located downstream in the sliding direction of, and spaced away from, the first supporting face 164. The second supporting face 165 has a second downstream edge 165A and a second upstream edge 165B. The second downstream edge 165A is located downstream in the sliding direction of the second supporting face 165, and the second upstream edge 165B is located upstream in the sliding direction of the second supporting face 165. The second upstream edge 165B has a first end side, a central portion, and a second end side in the leftward/rightward direction, at which are respectively located a fourth point (fourth portion) B4, a fifth point (fifth portion) B5, and a sixth point (sixth portion) B6. The fourth point B4, the fifth point B5, and the sixth point B6 are located on a convex line protruding toward the sliding direction upstream, such that the fifth point B5 is located further toward the sliding direction upstream than the fourth point B4 and the sixth point B6. The second downstream edge 165A is formed in conformance with the convex-shaped second upstream edge 165B.

A first distance L is defined as a distance in the frontward/rearward direction from the second point A2 to the fifth point B5. Meanwhile, a second distance L2 is defined as a distance in the frontward/rearward direction from the first point A1 to the fourth point B4. The second distance L2 is larger than the first distance L1. In addition, a third distance L3 is defined as a distance in the frontward/rearward direction from the third point A3 to the sixth point B6. The third distance L3 is larger than the first distance L1, since the second supporting face 165 forms protruding shape.

Moreover, the difference between the first distance L1 and the second distance L2 (i.e. L2–L1) and the difference between the first distance L1 and the third distance L3 (i.e. L3–L1) can be ranging from 0.5 to 10.0 mm, or 1.0 to 7.0 mm, or 1.5 to 5.0 mm.

Figure 4D:
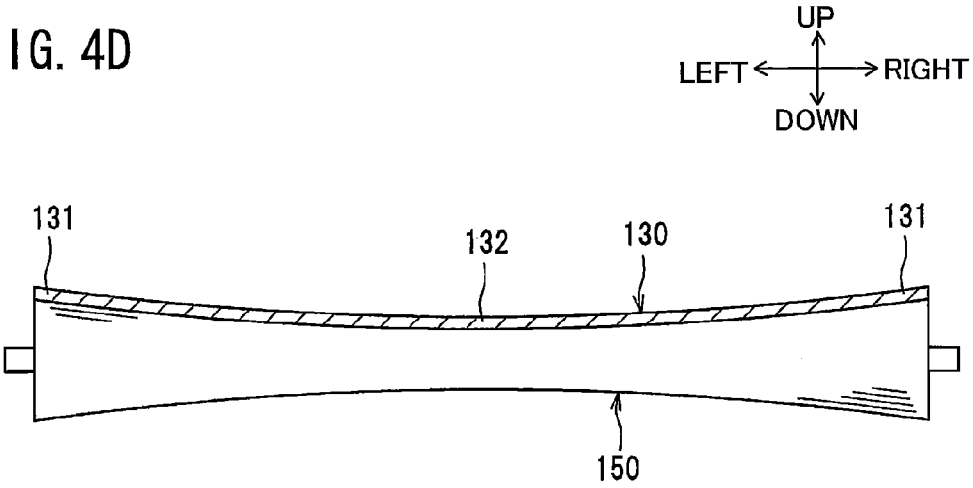
FIG. 4D is a cross sectional view taken along line III-III of FIG. 4A.

By making the distance L2 between the first end sides (the first point A1 and the fourth point B4) and the distance L3 between the second end sides (the third point A3 and the sixth point B6) greater than the distance L1 between the central portions (the second point A2 and the fifth point B5) of the first downstream edge 164A and the first upstream edge 164B. Accordingly, a pair of ends 131 of the nip plate 130 in the leftward/rightward direction becomes more flexible than the central portion of the nip plate 130 in the leftward/rightward direction, as shown in exaggerated fashion in FIGS. 4B and 4C. In this way, as shown in FIG. 4D, the nip plate 130 can be imparted with a convex shape wherein the central portion 132 in the leftward/rightward direction protrudes farther than the ends 131 toward the pressure roller 150. Incidentally, members such as the reflection plate 140 and the fusing belt 110 have been omitted in FIG. 4D for the sake of convenience.

Since the distance between the first downstream edge 164A and the second upstream edge 165B differs in the axial direction, the amount of protrusion of the central portion 132 can be adjusted properly. Accordingly, errors in the amount of protrusion can be reduced in comparison to conventional technology wherein the amount of protrusion of the central portion of the nip member is adjusted directly by performing machining (press working) on the surface of the nip member in contact with the fixing belt.

In addition, the supporting faces 164 and 165 can be easily formed by the aforementioned machining (press working), because the downstream edges 164A and 165A are arrayed in parallel as well as the upstream edges 164B and 165B. Comparatively, if these edges are not formed in conformance with each other, the machining can be more difficult.

The first point A1, the second point A2, the third point A3, the fourth point B4, the fifth point B5, and the sixth point B6 are disposed within a sheet width BB. Here, the sheet width BB refers to a width of one of multiple types of sheets P that can be specified for the laser printer 1. In other words, the fixing device 100 is configured to convey sheets P within a conveyance region having a prescribed width in the leftward/rightward direction (the same width as the sheet width BB shown), and to the nip region NP. Here, the conveyance region can be defined as an area where the nip region NP and the conveyed sheet P overlaps with each other, when viewed in the vertical direction.

Incidentally, the sheet width BB for determining respective positions of the points A1 to B6 can be 176 mm to conform to B5 size, 215.9 mm to conform to letter or legal size, or 210 mm to conform to A4 size, of the International Organization for Standardization (ISO).

By thus locating the respective points A1 to B6 within the sheet width BB, the nip region NP within the applicable sheet width BB can be formed into a convex shape such as that described above, and wrinkling of the sheets P conforming to the sheet width BB can be prevented effectively.

The respective points A1 to B6 will now be described more specifically. The first point A1 and the fourth point B4 are disposed within a range at least 55 mm and at most 107 mm from a conveyance center line CL of the conveyance path of the sheets P in the axial direction. The third point A3 and the sixth point B6 are disposed within a range at least 55 mm and at most 107 mm from the conveyance center line CL of the conveyance path of the sheets P in the axial direction.

The first point A1 and the fourth point B4 are disposed within a range at least 60 mm and at most 95 mm from the conveyance center line CL in the axial direction. The first point A1 and the fourth point B4 are disposed within a range at least 60 mm and at most 95 mm from the conveyance center line CL in the axial direction.

Here, the conveyance center line CL refers to a line which constitutes a conveyance reference line when respective sheets P of various types differing in width are conveyed without altering the position of the center portion in the leftward/rightward direction, i.e. a line which runs through the center portion of different types of sheets P being conveyed.

The first downstream edge 164A and the second upstream edge 165B are formed substantially symmetrically relative to the conveyance center line CL of the sheets P. That is, a distribution along the axial direction of distances between the first downstream edge 164A and the second upstream edge 165B in the sliding direction is symmetrical with respect to the conveyance center line CL of the sheets P. In other words, a distribution along the axial direction of distances between the first downstream edge 164A and the second upstream edge 165B in the sliding direction is symmetrical with respect to a surface which contains the conveyance center line CL and is orthogonal to the leftward/rightward direction.

Here, the definition of "symmetrical" includes configurations wherein a difference of up to 0.9 mm exists between two distances: one distance between the edges 164A and 165B when measured at a location that is on one side of the conveyance center line CL and separated from the conveyance center line CL by X mm (an arbitrary distance), and another distance between the edges 164A and 165B when measured at a location that is on another side of the conveyance center line CL and separated from the conveyance center line CL by X mm (the same distance as the arbitrary distance).

In addition, the definition of "symmetrical" also includes configurations wherein a difference of up to 0.6 mm exists between two distances: one distance between the edges 164A and 165B when measured at a location that is on one side of the conveyance center line CL and separated from the conveyance center line CL by X mm (an arbitrary distance), and another distance between the edges 164A and 165B when measured at a location that is on another side of the conveyance center line CL and separated from the conveyance center line CL by X mm (the same distance as the arbitrary distance) in the leftward/rightward direction.

In addition, the definition of "symmetrical" also includes configurations wherein a difference of up to 0.4 mm exists between two distances: one distance between the edges 164A and 165B when measured at a location that is on one side of the conveyance center line CL and separated from the conveyance center line CL by X mm (an arbitrary distance) in the leftward/rightward direction, and another distance between the edges 164A and 165B when measured at a location that is on another side of the conveyance center line CL and separated from the conveyance center line CL by X mm (the same distance as the arbitrary distance).

According to these configurations, the sheets P can be more readily conveyed on a straight path following the conveyance center line CL in comparison to configurations wherein the distances between the first downstream edge 164A and the second upstream edge 165B in the sliding direction are not symmetrical.

As indicated by a broken line in FIG. 4A, the nip region NP is defined so as to be located downstream in the sliding direction of the first downstream edge 164A and upstream of the second upstream edge 165B. That is, the nip region NP is defined so as to not protrude out from the first downstream edge 164A and the second upstream edge 165B in the frontward/rearward direction. The pressure roller 150 is thereby brought into pressing contact with the nip plate 130 between the supporting faces 164 and 165. Thus the ends 131 and the central portion 132 of the nip plate 130 can be bent by an intended amount, and the amount of protrusion of the central portion 132 can be adjusted effectively.

Incidentally, the present invention is not limited to the above-described embodiment, and can be utilized according to a variety of modifications, as will be described below. In the descriptions below, members having a structure substantially identical to that in this embodiment are assigned by the same numerals and characters as those shown in this embodiment.

Figure 5:
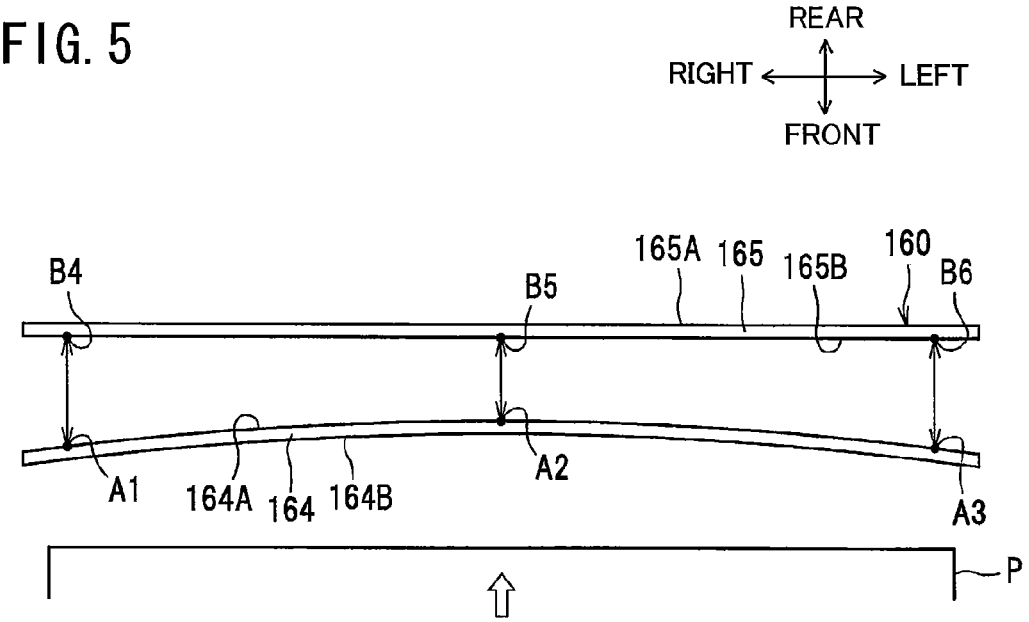
FIG. 5 shows a stay according to a first modification of the present invention.

In this embodiment, the first downstream edge 164A was formed into a straight shape parallel to the leftward/rightward direction, and the second upstream edge 165B was formed into an arcuate shape protruding frontward. However, the present invention is not limited to this configuration. For example, as shown in FIG. 5, a first modification is available wherein the first downstream edge 164A is formed into a convex shape protruding toward downstream in the sliding direction, and the second upstream edge 165B is formed into a straight shape parallel to the leftward/rightward direction.

More specifically, in this embodiment, the first downstream edge 164A is formed such that the second point A2 at the central portion is located downstream in the sliding direction of the first point A1 and the third point A3. In this case as well, the distance between the respective first end sides (the first point A1 and the fourth point B4) and the distance between the respective second end sides (the third point A3 and the sixth point B6) of the first downstream edge 164A and the second upstream edge 165B can be made larger than the distance between the respective central portions (the second point A2 and the fifth point B5). Thus, a similar effect as with the above-described embodiment can be achieved.

Figure 6:
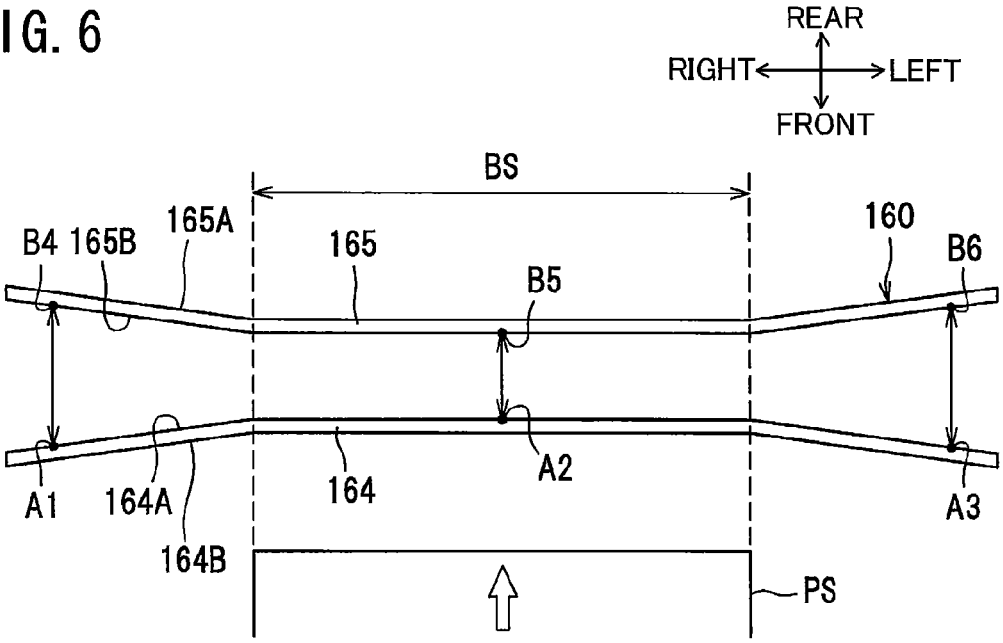
FIG. 6 shows a stay according to a second modification of the present invention.

In addition, as shown in FIG. 6, a second modification is available wherein the first downstream edge 164A is formed into a convex shape protruding toward downstream in the sliding direction, and the second upstream edge 165B is formed into a convex shape protruding toward upstream in the sliding direction. More specifically, in this modification, the first downstream edge 164A is formed such that the second point A2 at the central portion is located upstream in the sliding direction of the first point A1 and the third point A3.

The second upstream edge 165B is formed such that the fifth point B5 at the central portion is located upstream in the sliding direction of the fourth point B4 and the sixth point B6. In this case as well, the distance between the respective first end sides (the first point A1 and the fourth point B4) and the distance between the respective second end sides (the third point A3 and the sixth point B6) can be made larger than the distance between the respective central points (the second point A2 and the fifth point B5), and thus a similar effect as with the above-described embodiment can be achieved.

In addition, as shown in FIG. 6, the first downstream edge 164A and the second upstream edge 165B can also be formed in parallel in the axial direction of the pressure roller 150 within a minimum sheet width BS. Here, the minimum sheet width BS refers to a width of sheets PS having the minimum width that can be specified with the laser printer 1, in other words a minimum sheet width that can be specified using a width guide of the sheet supply tray 31. For example, the minimum sheet width BS can be set to postcard width (100 mm).

According to this configuration, the minimum width sheets PS can be more readily conveyed on a straight path in the frontward/rearward direction in comparison to configurations wherein a first downstream edge and a second upstream edge are not parallel in the axial direction within the minimum sheet width BS.

In the above-described embodiment, the nip plate 130 is formed into a substantially plate-like shape. However, the present invention is not limited to this configuration. For example, as shown in FIG. 7A as a third modification, a front portion 231 of a nip plate 230 can be formed into an arcuate shape so as to curve upward. In this case, lower end faces of front walls 262 and 242 can be formed so as to be more upwardly offset than lower end faces of rear walls 263 and 243 of the stay 260 and the reflection plate 240.

That is, in this modification, a first supporting face 264 is disposed at a location that is more upwardly offset than a second supporting face 265. Because a lower end portion of the front wall 262 is bent frontward, the lower end face of the front wall 262 is formed over a wide area in the frontward/rearward direction, and a portion of this wide lower end face supports a front end face 232 of the nip plate 230 through the reflection plate 240.

Figure 7C:
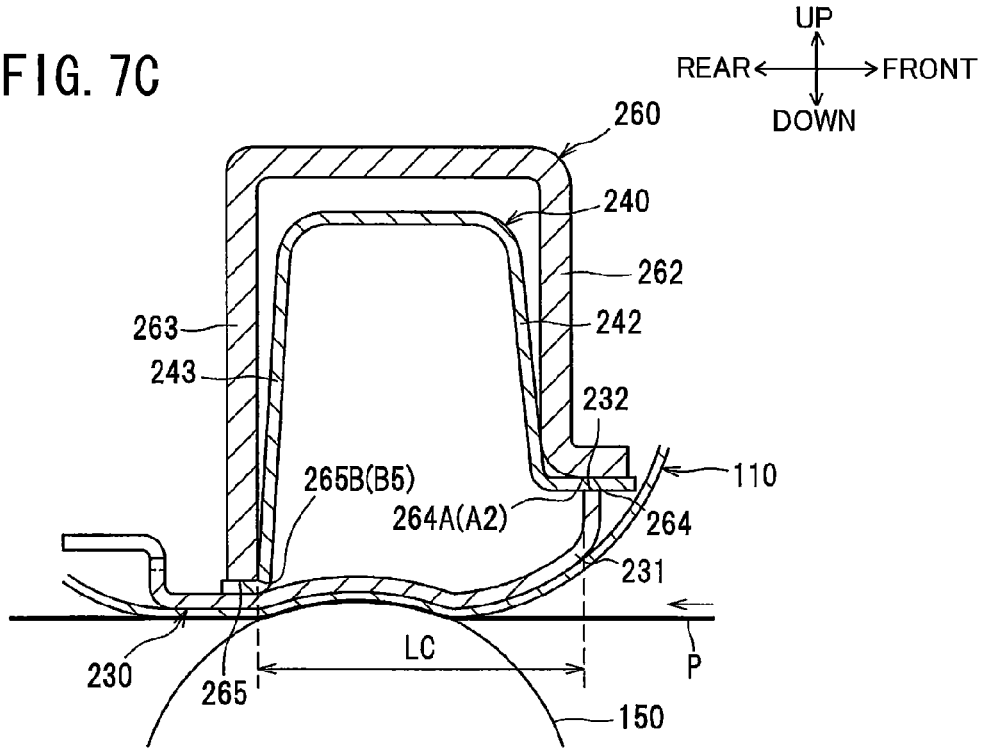
FIG. 7C shows a center portion of the stay according to the third modification of the present invention.

In addition, in the third modification, as shown in FIG. 7B, first supporting face 264 refers to a surface constituting a region wherein a portion of the wide lower end face of the front wall 262 overlaps with the front end face 232 when viewed in the vertical direction. Moreover, by making a distance LE between a pair of end points (A1 and A3) and another pair of end points (B4 and B6) larger than a distance LC between two central points A2 and B5 as shown in FIG. 7C, the same effect as with the above-described embodiment can be achieved.

In the above-described embodiment, the pressure roller 150 as a rotating member was configured such that, when the fixing operation is not being performed, the respective diameters of the end portions 152A and 152C are larger than the diameter of the central portion 152B. However, the present invention is not limited to this configuration. A pressure roller can be configured such that, at least when fixing operation is being performed, diameters of end portions are larger than a diameter of a central portion.

As one example of the above configuration, the pressure roller can be configured to have a shaft, an elastic layer covering the shaft, and a tube over the elastic layer, wherein a first end portion and a second end portion of the tube in the axial direction have wrinkles. In this case, when fixing operation is not being performed, the respective end portions and the central portion of the pressure roller have substantially the same diameter. However, when fixing operation is being performed, i.e. when heat is applied to the pressure roller, the wrinkles expand, and the respective diameters of the end portions of the pressure roller become larger than the diameter of the central portion.

As another example, the pressure roller can be configured to have a shaft and an elastic layer coating the shaft, wherein the respective diameters of a first end portion and a second end portion of the shaft are smaller than the diameter of a central portion of the shaft and, in addition, the diameter of the elastic layer is constant in the axial direction. In this case as well, when fixing operation is not being performed, the respective end portions and the central portion of the pressure roller have substantially the same diameter, but the elastic layer is thick at the end portions thereof and thin at the central portion thereof, and when fixing operation is being performed, i.e. when heat is applied to the pressure roller, the end portions of the elastic layer expand more than the central portion of the elastic layer, and the respective diameters of the end portions of the pressure roller become larger than the diameter of the central portion of the pressure roller.

In the above-described embodiment, the distances L2 and L3 between the pair of end points (A1 and A3) and the pair of end points (B4 and B6) are respectively larger than the first distance L1. However, the present invention is not limited to this configuration. If at least a distance between end points at one end is made larger than the first distance, distances between respective end points can be configured in any arbitrary manner.

In the above-described embodiment, the nip region NP was prescribed to be located downstream in the sliding direction of the first downstream edge 164A, and upstream in the sliding direction of the second upstream edge 165B. However, the present invention is not limited to this configuration. The nip region can be located downstream of the first point, and the third point, and upstream of the fourth point and the sixth point. That is, the nip region can protrude toward upstream of the second point and downstream of the fifth point at the central position.

In the above-described embodiment, the nip plate 130 supports the stay 160 through the reflection plate 140. However, the present invention is not limited to this configuration. The nip member may support the stay directly.

Further, the sheet P can be an OHP sheet instead of plain paper and a postcard.

Further, in the depicted embodiment, the pressure roller 150 is employed as a rotating member. However, a belt like pressure member is also available.

Further, in the depicted embodiment, the image forming device is the monochromatic laser printer. However, a color laser printer, an LED printer, a copying machine, and a multifunction device are also available. In this case, the axial direction of one of the rollers supporting the belt constitutes the axial direction of the rotating body.

Further, in the depicted embodiment, the nip plate 130 is employed as a nip member. However, a block shaped member or a pad like member is also available.

Further, in the depicted embodiment, the halogen lamp 120 is employed as a heater. However, a carbon heater is also available.

What is claimed is:

1. A fixing device comprising:

a nip member;

an endless belt having an inner peripheral surface and an outer peripheral surface, the inner peripheral surface being configured to be in sliding contact with the nip member in a sliding direction;

a rotating member configured to nip the endless belt in cooperation with the nip member, and configured to constitute a nip region between the endless belt and the rotating member, the rotating member having an axis defining an axial direction; and a stay disposed opposite to the nip region with respect to the nip member and having a first supporting face configured to support the nip member and a second supporting face configured to support the nip member, the second supporting face being spaced apart from the first supporting face in the sliding direction and being disposed downstream of the first supporting face in the sliding direction, one of the first supporting face and the second supporting face being formed in an arcuate shape when viewed in a direction perpendicular to the axial direction and the sliding direction, and a remaining one of the first supporting face and the second supporting face having a portion parallel to the axial direction, the first supporting face having a first upstream edge and a first downstream edge positioned downstream of the first upstream edge in the sliding direction, the first downstream edge having one side portion as a first portion, another side portion as a third portion, and a central portion as a second portion in the axial direction, the first portion being positioned opposite to the third portion in the axial direction, the second portion being positioned between the first portion and the third portion, the second supporting face having a second upstream edge and a second downstream edge positioned downstream of the second upstream edge in the sliding direction, the second downstream edge having one side portion as a fourth portion, another side portion as a sixth portion, and a central portion as a fifth portion in the axial direction, the fourth portion being positioned opposite to the sixth portion in the axial direction, the fifth portion being positioned between the fourth portion and the sixth portion, and the second portion and the fifth portion defining a first distance therebetween in the sliding direction, the first portion and the fourth portion defining a second distance therebetween in the sliding direction, and the third portion and the sixth portion defining a third distance therebetween in the sliding direction, the second distance and the third distance being longer than the first distance.

2. The fixing device according to claim 1, wherein the first portion, the second portion, the third portion, the fourth portion, the fifth portion and the sixth portion are disposed within a width of a recording sheet in the axial direction.

3. The fixing device according to claim 2, wherein the first portion and the fourth portion are positioned away from a conveyance center line of the recording sheet in the axial direction by a length ranging from 55 mm to 107 mm in the axial direction; and wherein the third portion and the sixth portion are positioned away from a conveyance center line of the recording sheet in the axial direction by a length ranging from 55 mm to 107 mm in the axial direction.

4. The fixing device according to claim 2, wherein the first downstream edge and the second upstream edge provide a distance therebetween in the sliding direction and provide a distance distribution in the axial direction, the distance distribution being symmetrical with respect to a conveyance center line of the recording sheet in the axial direction.

5. The fixing device according to claim 2, wherein the recording sheet has a width of 176 mm.

6. The fixing device according to claim 2, wherein the recording sheet has a width of 215.9 mm.

7. The fixing device according to claim 2, wherein the recording sheet has a width of 210 mm.

8. The fixing device according to claim 1, wherein the fifth portion is disposed upstream of the fourth portion and the sixth portion in the sliding direction.

9. The fixing device according to claim 8, wherein the second upstream edge has a convex shape protruding upstream in the sliding direction.

10. The fixing device according to claim 8, wherein the second upstream edge has a shape in conformance with a shape of the second downstream edge.

11. The fixing device according to claim 1, wherein the second portion is disposed downstream of the first portion and the third portion in the sliding direction.

12. The fixing device according to claim 11, wherein the first downstream edge has a convex shape protruding downstream in the sliding direction.

13. The fixing device according to claim 11, wherein the first downstream edge has a shape in conformance with a shape of the first upstream edge.

14. The fixing device according to claim 1, wherein the stay is fabricated by press Working.

15. The fixing device according to claim 1, wherein the rotating member is a roller, the roller having a first end portion, a second end portion, and a center portion, the first end portion being disposed opposite to the second end portion with respect to the center portion in the axial direction, the first end portion and the second end portion having a diameter larger than that of the center portion at least during fixing operation.

16. The fixing device according to claim 1, wherein the rotating member is a roller, the roller having a first end portion, a second end portion, and a center portion, the first end portion being disposed opposite to the second end portion with respect to the center portion in the axial direction, the first end portion and the second end portion have diameters larger than that of the center portion.

17. The fixing device according to claim 1, wherein the nip region is disposed downstream of the first portion and the third portion in the sliding direction, and upstream of the fourth portion and the sixth portion in the sliding direction.

18. A fixing device comprising:

a nip member;

an endless belt having an inner peripheral surface and an outer peripheral surface, the inner peripheral surface being configured to be in sliding contact with the nip member in a sliding direction;

a rotating member configured to nip the endless belt in cooperation with the nip member, and configured to constitute a nip region between the endless belt and the rotating member, the rotating member having an axis defining an axial direction; and a stay having a first supporting face configured to support the nip member and a second supporting face configured to support the nip member, the second supporting face being spaced apart from the first supporting face in the sliding direction and being disposed downstream of the first supporting face in the sliding direction, one of the first supporting face and the second supporting face being formed in an arcuate shape when viewed in a direction perpendicular to the axial direction and the sliding direction, remaining one of the first supporting face and the second supporting face having a portion parallel to the axial direction, the first supporting face having a first upstream edge and a first downstream edge positioned downstream of the first upstream edge in the sliding direction, the first downstream edge having one side portion as a first portion, another side portion as a third portion, and a central portion as a second portion in the axial direction, the first portion being positioned opposite to the third portion in the axial direction, the second portion being positioned between the first portion and the third portion, the second supporting face having a second upstream edge and a second downstream edge positioned downstream of the second upstream edge in the sliding direction, the second downstream edge having one side portion as a fourth portion, another side portion as a sixth portion, and a central portion as a fifth portion in the axial direction, the fourth portion being positioned opposite to the sixth portion in the axial direction, the fifth portion being positioned between the fourth portion and the sixth portion, and the second portion and the fifth portion defining a first distance therebetween in the sliding direction, the first portion and the fourth portion defining a second distance therebetween in the sliding direction, the second distance being longer than the first distance.

19. A fixing device comprising: a nip member; an endless belt having an inner peripheral surface and an outer peripheral surface, the inner peripheral surface being configured to be in sliding contact with the nip member in a sliding direction;

a rotating member configured to nip the endless belt in cooperation with the nip member, and configured to constitute a nip region between the endless belt and the rotating member, the rotating member having an axis defining an axial direction; and a stay disposed opposite to the nip region with respect to the nip member and having a first supporting face configured to support the nip member and a second supporting face configured to support the nip member, the second supporting face being spaced apart from the first supporting face in the sliding direction and being disposed downstream of the first supporting face in the sliding direction, the first supporting face having a first upstream edge and a first downstream edge positioned downstream of the first upstream edge in the sliding direction, the first downstream edge having one slide portion as a first portion, another side portion as a third portion, and a central portion as a second portion in the axial direction, the first portion being positioned opposite to the third portion in the axial direction, the second portion being positioned between the first portion and the third portion, the second supporting face having a second upstream edge and a second downstream edge positioned downstream of the second upstream edge in the sliding direction, the second downstream edge having one side portion as a fourth portion, another side portion as a sixth portion, and a central portion as a fifth portion in the axial direction, the fourth portion being positioned opposite to the sixth portion in the axial direction, the fifth portion being positioned between the fourth portion and the sixth portion, the second portion and the fifth portion defining a first distance therebetween in the sliding direction, the first portion and the fourth portion defining a second distance therebetween in the sliding direction, and the third portion and the sixth portion defining a third distance therebetween in the sliding direction, the second distance and the third distance being longer than the first distance, and the first downstream edge being formed into a convex shape protruding downstream in the sliding direction, the second upstream edge being formed into a convex shape protruding upstream in the sliding direction, the second portion and the fifth portion extending parallel to each other in the axial direction.

20. The fixing device according to claim 19, wherein the second portion and the fifth portion are located within a minimum width of a recording sheet in the axial direction.

* * * * *